US005868325A

United States Patent [19]

Tassinari

[11] Patent Number: 5,868,325

[45] Date of Patent: Feb. 9, 1999

[54] PRESSURE LIMITING WATER SAVER

[76] Inventor: David Tassinari, 21 Brogan Rd., Medford, Mass. 02155

[21] Appl. No.: 662,044

[22] Filed: Jun. 12, 1996

[51] Int. Cl.[6] ..... B05B 1/04

[52] U.S. Cl. ..... 239/602; 239/533.13; 239/DIG. 12

[58] Field of Search ..... 239/533.13, 602, 239/DIG. 12

[56] References Cited

U.S. PATENT DOCUMENTS

| | | | |
|---|---|---|---|
| 2,171,023 | 8/1939 | Buxton | 239/602 |
| 3,129,894 | 4/1964 | Schermerhorn | 239/602 |
| 3,199,787 | 8/1965 | Oishei et al. | 239/533.13 |
| 3,214,102 | 10/1965 | Meyer | 239/533.13 |
| 3,286,931 | 11/1966 | Webb | 239/602 |
| 3,711,020 | 1/1973 | Zelna | 239/602 |
| 4,109,836 | 8/1978 | Falarde | 239/533.13 |
| 4,113,183 | 9/1978 | Stuart, Sr. | 239/533.13 |
| 5,074,471 | 12/1991 | Baumgarten et al. | 239/602 |
| 5,271,566 | 12/1993 | Dederich | 239/602 |

*Primary Examiner*—J. Casimer Jacyna

[57] ABSTRACT

This invention teaches a slidably attaching water flow limiting device which utilizes elastic and frictional forces to apply a force holding the flow limiting device onto a faucet such that these forces are exceeded at excess flow into the interior chamber of the water limiting device causing it to blow off the faucet. The water flow limiting device through a shaped hole restricted in area also provides a cleaning jet which makes the reduced flow effective for cleansing purposes despite the reduced flow rate.

1 Claim, 1 Drawing Sheet

PRESSURE LIMITING WATER SAVER

FIELD OF INVENTION

This invention covers a method and device to improve the cleaning of razors and toothbrushes by provision of a shaped jet of water from a pressure limiting nozzle onto the brush or razor.

BACKGROUND AND PRIOR ART

Water is an increasingly costly necessity and in many areas it is also frequently a scarce commodity. The costs of treatment, supply and the associated waste treatment have resulted in dramatic rises in water costs in recent years. The weather patterns have also been unsettled providing periods of excess water and then dry periods where reservoirs and surface water supplies have been severely depleted causing water emergencies where use is strictly limited. In a few areas in recent years, a total use limit has been set. There is clearly a financial and an environmental reason to limit the use of water, especially since much of our "use" is actually waste when faucets run while other actions are taking place. Water conservation is a need.

The list of gadgets that can be used to redirect water is vast. The early faucet attachments were sold in the 1940's and consisted of rubber cones with internal bumps to engage the end of tub faucets. These friction based attaching heads were used to redirect water to a spray head thus providing a shower like flow within the bathtub. Most of these gadgets redirect and do not save water. There is a need for a water saver.

There have been a number of devices, especially those for a bathtub faucet, that attempt to attach to a faucet and convey streams of water to a place where they can be used more easily. The early tubs were soon followed by a series of spray head terminated hoses that slidably engaged the stubby faucet within a cone of rubber that, held onto the faucet by friction, conveyed the water to the spray and made the tub more like a shower. The attachments of that period emphasized the firm attachment of the hose to the faucet and any device that could not resist water pressure in use and popped off the faucet was a commercial failure. Other devices attached to faucets. Spray heads that proceeded the aerator now in use on almost all kitchen and bathroom faucets were often slidable pressed over the tip of a faucet and clamped or held in place by rings that acted like O ring gaskets. In all cases, firm resistance to the water pressure so that a maximum flow was possible was a key goal.

Garden watering also represents an area where there was major patenting efforts over the years. U.S. Pat. No. 2,921,744 to Falcetti as an example emphasizes an angled support and heads that provide a fan shaped spray. Large volume flows are critical in these applications and the square shape of the nozzle and its fixed attachment to a hose are critical in functioning of this device. Other shaped flows designed for a high rate of flow are shown in an invention of Chow (U.S. Pat. No. 4,534,512) where a pistol grip housing has several rotatable nozzles. The Garden nozzles are designed to handle high pressures and to maximize flows so watering is possible over a distance and is quick.

Volume controls are also well known. The simple restrictor orifice plates added to shower heads that limit the flow of water, thus reducing water use, and the aerator with screens that by merging air and water streams makes a flow seem larger are both aspects of flow restriction. The tailoring of flows in shape is noted from paint sprayers and similar nozzle technology.

Pressure limitations are usually applies in water flows at the meter end of a household water system. While these pressure controls are large and bulky, the more common pressure limits are on hot water heaters where they are safety devices set to release pressure rather than to allow the heater to burst. The use of pressure limiting devices to restrict flow of water at the use point seems sadly neglected. Full flows and tap pressures are typically used for tasks such as cleaning razors and toothbrushes. The cleaning is helped by hitting the razors on the sink or squeezing brushes. The flows ideal to such cleaning tasks are not very useful for other large volume water uses and so the usual full flow from the faucet is used for nearly all tasks. This will be a future problem as water supplies become increasingly tight and the regulation dominated costs of water and sewage continue to escalate.

There were also a variety of cleaners, specifically a number of razor cleaners. In U.S. Pat. No. 4,941,492 a specific razor rinsing device is shown where an attachment to a faucet is made by means of a slidable grip that allows a flow of water from the faucet to the strip jet that is directed upon a razor that is fixed in a cleaning jig positioning device. While the device directs a water flow, the flow is fixed and does not reduce the volume of water used.

A further razor cleaner is revealed in U.S. Pat. No. 4,838,949 where Dugrot again uses an attachment to a conventional water faucet by means of a watertight engaging means which is a slide on faucet cover, the water flow going through the narrowed jet orifice then impinging on a deflector plate to create a fan shaped water stream which impinges upon a razor which is placed in a fixed locator guide rail device. Aside from complexity, the Dugrot device provides a useful flow but then restricts the use to only a razor and further does not restrict water volume.

A further razor cleaner by Kellis (U.S. Pat. No. 4,027,387) attaches to a fluid source or faucet with a telescoping chamber to hold a razor and a water distributor that directs the flow over the razor which is fixedly mounted within a chamber and then to a drain. The attachment to the faucet is a press on internal attachment to the faucet.

Razors are cleaned in a casing that holds a cartridge with a water inlet where the water is directed to and through the blade area toward the interior of the razor head then to the drain. The device in this U.S. Pat. No. (4,480,387) s again a fixed holder that accommodates a blade cartridge with a relatively watertight seal to force water through the blade area.

Not all cleaners that are faucet attachable are used for razors. Eberle used a water flow in U.S. Pat. No. 3,009,468 to clean dentures by clamping shell shaped segments to a faucet and directing the water flow from the faucet through and around a set of dentures to clean them. Again volume of water is not reduced and the device is a one purpose cleaner that uses as much pressure as possible to clean.

Attachments are also patented with U.S. Pat. No. 2,990,123 to Hyde showing a typical shower head attachment which shows a permanent attachment of a spray nozzle using a metal ring to apply pressure to a gasket which is forced inwardly to hold onto a knob of metal. This is not easily removable so any use makes the shower only usable with the spray pattern of the flow deflector.

There is also a considerable technology in jet or nozzle shapes and attachments. In D320,063 a cone is shown but the attachment is threaded which limits detachability and makes for a permanent attachment. The same problem exists for D322,837 which is a multijet flow device and for the hand spray of the multijet Pat. D318,517.

Water jets are used in a number of interesting Patents. U.S. Pat. No. 3,943,951 is a fingernail cleaner where a jet of water is discharged into a chamber that holds a finger where the jet is combined with a soap or other cleaner prior to impingement in a very complex device attached to a water source. A similar device is shown in U.S. Pat. No. 3,982,965 where again a fixed position of a finger or toe is used inside a cleaning chamber and where the amount of cleaner can be varied.

The vegetable washer of U.S. Pat. No. 4,944,051 is a unique device where a faucet attachment is used to attach a bag that holds vegetables while a shower of water droplets cleans the dirt and sand from the vegetables. The device however lacks flow or pressure limiting capability and has a gentle spray action.

Mere nozzles are also patented with Sakka showing a nozzle that uses a slot cut into a conical shape that allows a reactor output to be combined with water or another fluid.

The predominate nozzle technology is paint based and U.S. Pat. No. 4,380,319 which shows a tubular channel with two inner orifices, one of which is biconvex shaped to provide a flat pattern spray which is fan shaped. The nozzle is threadably affixed to a liquid source and requires a set minimum pressure to work.

A more typical nozzle tip is shown in U.S. Pat. No. 618,101 where a removable pressure resistant attachment of a bore which is intersected by a slot that together provide a fan shaped flow of fluid under pressure. Other more complex nozzles are shown with U.S. Pat. No. 4,789,104 for a coaxial flow typical of the complex nozzle technology.

Volume controls are also well known. The simple restrictor orifice plates added to shower heads that limit flow of water and the aerator that by merging air and water streams makes a flow seem larger are both aspects of flow restriction. The tailoring of flows in shape is noted from paint sprayers and similar nozzle technology.

General pressure limitations are usually applied to water flows at the meter end of a household system. While these pressure controls are large and bulky, the more common pressure limits are on hot water heaters where they are safety devices set to release pressure rather than to allow the heater to burst. The use of pressure limiting devices to restrict flow of water at the point of use seems sadly neglected. Full flows and tap pressures are typically used for tasks such as cleaning razors and toothbrushes. The flows ideal to such cleansing tasks are not very useful for other large volume water uses and so the usual full flow from the faucet is used for nearly all tasks. This will be a future problem as water supplies become increasingly tight and the regulation dominated costs of water and sewage continue to escalate.

SUMMARY OF INVENTION

A need for lessened water consumption is met with a snap on elastomeric faucet end attachment where a set of continuous elastomeric ridges directed inward from the inner surface of the cylindrical attachment and directed downward contra to the direction of installation on the faucet end interacts with the faucet end and the frictional force of the elastomer when augmented by the pressure of water both holds the attachment to the end of the faucet and also provides a blow off feature if excess water volume is used. The pressure/volume limiting feature enables adequate safe flow from a shaped hole at the closed end of the cylindrical attachment which provides a shaped high velocity jet of fluid for rinsing and cleaning purposes such as cleaning of toothbrushes and razors while the amount of water used is sharply reduced.

DESCRIPTION OF INVENTION

The invention reduces the volume of water needed for critical cleaning or rinsing uses.

The invention further provides a uniform fan shaped jet of cleaning or rinsing water.

The invention finally provides pop off control over the total water pressure.

The invention consists of a hollowed rubber of elastomeric molded part where the hollowed portion is in fluid communication with the end of a faucet that contains a top attachment adjacent to the hollowed portion to grip the normal faucet with assistance from internal fluid pressure within the hollowed portion but which is easily removable when the faucet is needed for high flow uses. The invention further provides a molded tapered jet that is relatively round where it fluidly communicates with the hollowed portion and is successively flattened and shaped to provide a fan like fluid jet at the exit from the molded part and thus flattens internal fluid into a fan shape jet of fluid.

The invention of this fan jet cleaner is utilizable for bathroom cleaning and flushing of residues from such frequently used objects as combs, toothbrushes, razors and other toiletry devices. The shape of the jet, the self limiting flow feature, and the ease of attachment provides a device that allows water savings during much of the time spent in brushing teeth, shaving and other toilet functions. By limiting use of hot water it also saves energy costs. Since the flow is limited, the device also saves hot water and thus saves energy.

The invention has three portions that will be covered sequentially. The attachment is important both as the pressure limiting part of the invention and to provide ease of use. The hollowed portion provides the connection between the attachment and the jet and provides a small reservoir for fluid. The shaped jet provides the cleaning function and the restriction on total flow by making the jet more effective and more useful than a normal faucet flow of fluid.

The attachment consists of a triangularly shaped elastomer ring arrayed such that the triangle approximates an isosceles triangle with a relatively small base and a large height. This triangular shape is made into a ring, with the outer surface of the ring comprising the base of the isosceles triangle and the tip of the two equal sides forming the inner surface of the ring. So constructed, the ring becomes an annulus with a thinning as the annular segment is traversed from the outer surface towards the center. The inner diameter of the annular segment or ring is smaller than the faucets that it will be used with. The use of this ring when the ring is molded into the top portion of a hollowed center cylinder allows the ring to be slidably forced upward onto a faucet end and to be held there by frictional forces of the elastomeric ring against the metal or plastic of the faucet. The ring after sliding onto a faucet that is larger in diameter than the inner diameter of the annulus becomes angled counter to the direction of sliding onto the faucet. The angled thin inner portion of the ring, now surrounding the faucet end, is further forced against the faucet when pressure is applied to the area between the ring and the hollowed cylinder.

The arrangement of the slidably installed ring forced against the faucet is an effective pressure limiting device. The force of the elastomeric material of the ring against the faucet is a function of the area of the ring material in contact with the faucet, the coefficient of friction of the elastomeric material against the faucet, and the pressure of the fluid within the hollow cylinder (since this pressure is also applied to the ring on one side thus forcing the ring into the faucet). This frictional force, supplemented by minor flex forces from any bulging of the cylinder walls which are connected to the outer surface (base) of the triangular shaped ring and the elastomeric recovery forces of the ring, provides an automatic pressure limitation for the internal pressure within the invention. The forces of friction are balanced against the fluid force exerted by the fluid on the faucet in directions counter to the direction of sliding the invention onto the faucet. This force is approximated by the cross sectional area of the hollow portion of the cylinder plus the area of the faucet end times the pressure within the hollowed cylinder. When the force of friction is exceeded by the force applied by the pressure internal to the cylinder, the ring that was griping the faucet slides and the invention pops off the faucet. The internal pressure is determined by the flow into the hollow cylinder minus the flow out of the hollow cylinder. Since the diameter and materials of the faucets may vary and since flow out of the hollow cylinder is a pressure dependent function, the pop off pressure will vary in different applications but it will always limit the internal flow into the hollow cylinder to a relatively small amount forcing a great reduction in flow of fluid when the invention is used.

The hollow cylinder has two simple and non-patentable functions, to connect and hold the pressure limiting attachment rings and fluidly connect them to the jet and to provide a reservoir that makes it possible to adjust flows by slightly buffering the overpressure effects.

The hollow cylinder has a closed bottom into which is molded a shaped hole which forms a jet when in use. The shaped jet utilizes the moldability of elastomers and the unique feature of flexing the elastomer as pins or parts are withdrawn to dispense with the variety of fan jet techniques noted in the prior art and to make a true shaped jet that can deliver either a uniform flow or an edge emphasized flow of fluid in a flat fan configuration.

The shape involved consists of a round hole or shaped hole at the inside (fluid side) of the bottom portion of the molded part which remains round for at least two flow diameters and then is flattened with the total area remaining approximately equal but the width of the slot formed on the outer side of the bottom portion of the molded part being no more than one third of the diameter of the round or shaped entry hole and ideally less than one fifth of that diameter. The area remaining approximately equal, the length of the slot is determined from the width. It is noted that there is often an edge effect in fluid flows through a shaped hole. This edge effect where the flow is enhanced at the edges is most pronounced in compressible fluids, not in incompressible fluids such as water used in this invention, but it will still be noticeable. The hole may be further shaped with a reduction of width of up to 25% in the center portion of the slot width to emphasis the edge flow or the hole may have reduced width in the approximately one sixth of each end of the slot. The flow may thus be controlled by design of the shaped hole to cause nearly uniform flow across the slotlike outer end of the hole or it may be controlled to give prominent edge flows.

The invention thus consists of a hollow cylindrical body with a top portion containing a pressure relieving gripping ring which engages the end of a faucet which allows fluid flow into the hollow area and which, using friction enhanced by internal fluid pressure, holds the invention onto the faucet unless the pressure inside the hollow cylindrical body is excessive, and a closed bottom end to the hollow cylindrical body which contains a shaped hole which further creates a fan shaped fluid flow that is ideal for cleaning the implements used in the bathroom and other areas.

This invention is a device that creates a fan shape flow pattern and is easily removable. It also defines a system for cleaning where a device is first placed over the end of a faucet, the faucet is partially opened to provide a low level of pressure, self limited by the design of the device and its materials of construction, which assists in holding the device upon the faucet, and where water or fluid flow enters a reservoir area within the device and is subsequently allowed to exit the device through a shaped hole of substantially uniform cross section but with a flattening shape so the slot like exit from the device provides a fan shaped higher velocity jet of water or fluid which is then used to clean toothbrushes and other bathroom objects.

As a system, this series of steps for cleaning an object with a fan shaped jet is valuable in the limited and limiting flow of water and in the degree of cleaning caused by the jet action as compared to the cleaning of a slower non directed flow from a faucet.

PREFERRED EMBODIMENTS

Figure 1:
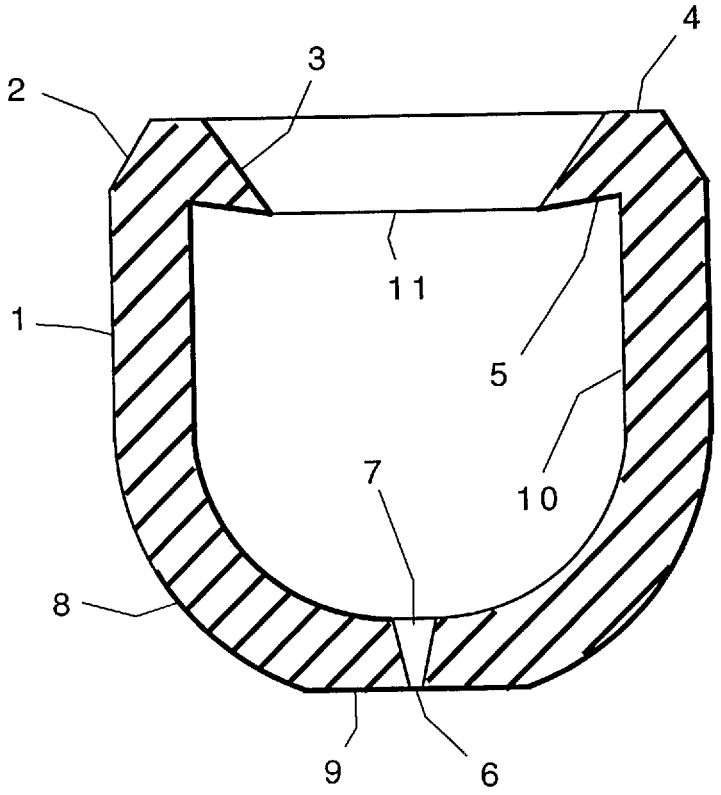
In FIG. 1, a cross section of the invention is shown with the gripping annular ring of a triangular shape and with a bottom hole that provides the jet.

The preferred embodiment of this invention is a molded rubber part which has a cross section as shown in FIG. 1. This part, made of a FDA grade of neoprene rubber such as Santoprene EPDM polypropylene mix, thermoplastic elastomer or neoprene elastomer Thermoplastic resin with a durometer of approximately 55 is molded using well known rubber and plastic injection molding processing methods. The body of the object between the outer surface 1 and the inner surface 10 is approximately ⅛th inch thick elastomer part. It consists of a cylindrical section that seamlessly is reduced in diameter to form a conical, spherical or elliptical portion 8 leading to the bottom flat, 9. The bottom 9 is flattened for convenience when the part is removed and placed on a sink or other surface. Into this bottom flat, a shaped hole from 7 to 6 is molded that is fluidly communicating from the inner side of the part to the outer surface and to ambient. The shape of the hole is defined by an input hole shape 7 and the output hole shape 6.

The gripping ring, shown in cross section in FIG. 1, has a top surface 3 and an inner surface 5 which with the base of the triangle as the wall of the cylindrical surface 10 forms a triangular gripping ring, the height of this triangle being defined by the inner diameter shown as 11. A flat top 4 and tapers 2 have no essential function. The gripping ring is integrally molded into the part.

The hole shape on the outlet side is shown in cross section in FIG. 1 where the hole shape 6 shows centrally located on the flat 9. The shape of the hole is in part defined by a width and a length, the ratio of length to width providing a fan shape rinsing jet when fluid contained under pressure in the part exits through the hole which fluidly communicates with the inside of the part.

In use the gripping ring is designed to be pushed upward over an aerator tip of a faucet. The aerator tip is relatively standard so the part fits almost all available tips. The sliding fit with the aerator tip bends the rubber triangular apex of the gripping ring and a combination of elastomeric pressure and friction holds the part on the aerator tip. The water tap is then turned on and the part fills rapidly with water. The pressure of the water applied to the surface 5 also presses the bent apex of the gripping ring such that bent surface 3 is forced tightly against the aerator tip further enhancing the grip on the aerator. As water pressure increases, a point is reached where the force of the water against the aerator directed away from the tip of the aerator exceeds the combined water pressure and frictional and elastic grip forces holding the part onto the aerator. At this point the part is blown off the faucet aerator. This blowoff feature creates an absolute limit on the pressure and thus indirectly on the volume of water that is used. This blowoff feature is determined by wall thickness, triangular ring shape, diameter of the gripping ring, and the materials of construction. At present it is empirically determined for each set of diameters that constitute a type of aerator or faucet tip.

In another preferred embodiment the part is molded from a thermoplastic elastomer such as a neoprene rubber of the Santoprene EPDM polypropylene mix, thermoplastic elastomer or neoprene type elastomer that has a durometer of between 45 and 65. This white pigmented material is molded by common rubber injection molding methods into a dome bottomed cylindrical shape. The top of the cylinder which is the end that adapts to a faucet, especially a faucet with an aerator, is a cylinder with walls of approximately ⅛th inch.

In a third embodiment the shape of the retaining ring which acts to hold the invention onto the aerator of the faucet is a isocoles triangle in shape with the equal sides projecting toward the aerator.

In a fourth embodiment the triangular shape of the retaining ring is a right triangle with the hypotenuse of the triangle directed away from the aerator of the faucet as the device slides onto the faucet.

In a fifth embodiment, the hole is shaped as an oval with the maximum width of the oval between approximately ¼th and 1/10th of the length of the oval.

In a sixth embodiment the hole is a rectangle or a parallelogram with the short sides having a length of approximately ¼th to 1/10th of the length of the long sides of the rectangle.

In a seventh embodiment the device has a triangular ring projecting inward from the cylindrical inner wall of the device which extends at least ¼ of the distance from the wall to the center of the cylinder but not more than ⅔ of that distance.

I claim:

1. A device for cleaning small objects comprising:

an elastomeric sleeve having a durometer of at least 45 but not more than 65, which sleeve is adapted to slidably fit over an end of a water faucet and includes a top, a bottom and an interior with an interior surface for the passage of water, said top having a pressure limiting annular ring which projects inwardly from said interior surface and is shaped as a triangle with one tip of said triangle providing the inward most portion of said annular ring which is adapted to slidably contact said water faucet, said bottom having a shaped water jet exit selected from a group consisting of an ellipse, a parallelogram, or a trapezoid, said exit forming a passage from the interior of said sleeve to ambient, wherein when the water faucet is turned on, water will fill the interior of the sleeve portion, the flow of water will be moderated to prevent excessive pressure where said annular rim acts to hold said elastomeric sleeve in place but will relieve any excessive pressure by slipping off said faucet when the water pressure is excessive, the internal water pressure causing a jet of water to exit from said shaped water jet exit of which jet of water is shaped into a small flattened fan of high velocity water in which jet objects to be rinsed may be placed.

* * * * *